United States Patent [19]

Bradley et al.

[11] Patent Number: 4,470,203

[45] Date of Patent: Sep. 11, 1984

[54] COOLING ASPHALTIC STRIP MATERIAL

[75] Inventors: Hugh W. Bradley, Newark; Albert J. Blackwood, Perrysburg; Thomas R. Brady; Donald R. Miller, both of Newark, all of Ohio

[73] Assignee: Owens-Corning Fiberglas Corporation, Toledo, Ohio

[21] Appl. No.: 446,837

[22] Filed: Dec. 6, 1982

[51] Int. Cl.[3] ..... F26B 3/00; F26B 7/00; F25D 17/02

[52] U.S. Cl. ..... 34/9; 34/13; 34/20; 34/54; 62/64

[58] Field of Search ..... 62/64, 171; 34/9, 13, 34/20, 54, 159, 43

[56] References Cited

U.S. PATENT DOCUMENTS

| | | | |
|---|---|---|---|
| 2,365,352 | 12/1944 | Moffitt | 62/168 |
| 3,324,566 | 6/1967 | Dietert | 34/54 |
| 3,664,146 | 5/1972 | Butts | 62/60 |
| 4,359,873 | 11/1982 | Miller | 62/63 |

OTHER PUBLICATIONS

Kercher, D. M., Tabakoff, W., "Heat Transfer by a Square Array of Round Air Jets Impinging Perpendicular to a Flat Surface Including Effect of Spent Air." ASME, Jour. Eng. Power, vol. 92, p. 73 (1970).

*Primary Examiner*—John J. Camby

*Attorney, Agent, or Firm*—Ronald C. Hudgens; Philip R. Cloutier; Ted C. Gillespie

[57] ABSTRACT

A method and apparatus for cooling a continuously moving strip of asphaltic material includes directing the asphaltic material into a plurality of loops, spraying an evaporative liquid onto the asphaltic material, evaporating the evaporative liquid by causing an array of air jets to impinge on the asphaltic material subtantially normally to the asphaltic material, sensing the surface moisture of the asphaltic material subsequent to one or more of the loops, and modifying the flow of evaporative liquid sprayed in one or more of the loops in response to the sensed surface moisture.

2 Claims, 4 Drawing Figures

COOLING ASPHALTIC STRIP MATERIAL

TECHNICAL FIELD

This invention pertains to the handling of continuous strips of asphaltic material, such as asphaltic material suitable for use as roofing membranes and roofing shingles. In one of its more specific aspects, this invention relates to the cooling of the asphaltic strip material in the production process.

BACKGROUND OF THE INVENTION

A common method for the manufacture of asphalt shingles is the production of a continuous strip of asphaltic shingle material followed by a shingle cutting operation which cuts the continuous strip into individual shingles. In the production of asphaltic strip material, either an organic felt or a glass fiber mat is passed through a saturator, containing liquid asphalt at a very hot temperature, to form a saturated asphaltic strip. Subsequently, the hot asphaltic strip is passed beneath a granule applicator which applies the protective surface granules to portions of the asphaltic strip material. In conventional shingle processes, the hot asphaltic strip material is next directed toward a cooling section where the asphaltic strip is held in the form of numerous loops. The cooling section of existing processes acts as an accumulator or temporary storage means for the asphaltic strip prior to shingle cutting and packaging. The asphaltic strip is maintained in the cooling section for a short period of time during which the asphaltic strip is cooled by the effects of the factory air acting on the loops. Some production processes provide for fans for blowing factory air through the loops, in a direction generally parallel to the lengths of material in the loops, and generally perpendicular to the machine direction of the shingle production machine. Some production processes use a water spray to wet the asphaltic strip prior to the blowing of air through the loops.

One of the problems associated with existing shingle production processes is that during the summer months, when factory air is at elevated temperatures and can be well over 100° F., the cooling section is insufficient to cool the asphaltic strip to the degree required for proper cutting and packaging of the shingles. This is especially true in relatively warm climates, such as the southern portion of the United States. The problem of inability to cool the shingle can also be bothersome in cool weather because outside cooling air applied to the asphaltic strip can evaporate and hold much less moisture than warm air can. If the asphaltic strip is too hot, the shingle cutting operation is adversely affected. Also the shingle packaging operation becomes less efficient when the shingles are too hot, and hot shingles become a greater fire hazard once they are packaged. Also, it is desirable to avoid packaging wet shingles. As new technology is applied to existing shingle production facilities, the speed with which the continuous asphaltic strip can be produced is increased. Thus, it has been found that in many cases the limiting factor in increasing the speed and the efficiency of a shingle production machine is the ability to cool and dry the asphaltic strip prior to cutting and packaging.

One of the attempts to solve the problem of cooling asphaltic strip material is disclosed in U.S. Pat. No. 2,365,352, to Moffitt. Moffitt describes a continuous asphaltic strip production process in which the cooling section contains a single water spray means for spraying water onto the loops of shingles as the loops are formed in the cooling section. Moffitt also provides for blowing cooling air through the loops, in a direction parallel to the strip material, while the loops are in the cooling section. Moffitt's solution to the asphaltic strip cooling problem is disadvantageous in that the air flow is not perpendicular or normal to the asphaltic strip material and is, therefore, relatively inefficient. The relatively inefficient nature of Moffitt's cooling system necessitates a rather lengthy cooling section in the machine direction. Also, in part due to the inefficiency of the air flow, Moffitt's system requires an enclosed cooling section, which greatly increases the capital expense of the apparatus.

A cooling system proposed for solving the above problem of cooling asphaltic strip material provides for the use of repeated applications of spraying an evaporative liquid such as water onto the asphaltic material, with each application of evaporated liquid being followed by air jets impinging onto the asphaltic strip material in a direction normal to the strip material to evaporate the liquid, thereby cooling and drying the strip material. This proposed cooling system for cooling strip material is highly dependent on temperature and humidity conditions of the air being impinged upon the strip material. The higher the relative humidity of the air used to evaporate the liquid, the greater the difficulty in obtaining substantially complete evaporation of the liquid. Also, colder air is able to hold less moisture than warm air, and thus, the temperature affects the evaporation of the liquid. There is a need for a method and apparatus for cooling asphaltic strip material in which the ability of the air jets impinging on the asphaltic strip material to evaporate the liquid on the strip material is taken into account.

SUMMARY OF THE INVENTION

According to this invention, there is provided a method for cooling a continuously moving strip of asphaltic material comprising subjecting the asphaltic material to a plurality of cooling cycles, each cooling cycle comprising spraying evaporative liquid onto the asphaltic material from a means for spraying and evaporating the evaporative liquid immediately downstream from the means for spraying by causing gases to impinge on the asphaltic material substantially normally to the asphaltic material, and further sensing the surface moisture of the asphaltic materials subsequent to one or more of the cooling cycles, and modifying the flow of evaporative liquid sprayed in one or more of the cooling cycles in response to the sensed surface moisture.

In a preferred embodiment of the invention, the surface moisture is sensed subsequent to all of the cooling cycles.

In a more preferred embodiment of the invention, the flow of the evaporative liquid is sequentially stopped or decreased in order beginning with the furthest downstream of the cycles toward the furthest upstream of the cycles, in response to the sensed surface moisture.

According to the this invention, there is also provided a method for cooling a continuously moving strip of asphaltic material comprising subjecting the asphaltic material to a plurality of cooling cycles, each cooling cycle comprising spraying evaporative liquid onto the asphaltic material from a means for spraying and evaporating the evaporative liquid immediately downstream from the means for spraying by causing gases to impinge on the asphaltic material substantially normally to the asphaltic material, and further sensing the temperature of the asphaltic material subsequent to one or more of the cooling cycles, and modifying the flow of evaporative liquid sprayed in one or more of the cooling cycles in response to the sensed temperature.

In a preferred embodiment of the invention, the flow of evaporative liquid is sequentially started or increased in the order beginning with the furthest upstream of the cycles toward the furthest downstream of the cycles, in response to the sensed temperature.

According to this invention, there is also provided apparatus for cooling a continuously moving strip of asphaltic material comprising means for directing the asphaltic material into a plurality of loops, and a plurality of cooling units, each of the cooling units being associated with one of the loops, and each cooling unit comprising spraying means positioned to spray evaporative liquid onto the apshaltic material in the loop and air delivery means positioned immediately downstream from the spraying means and adapted to cause gases to impinge on the asphaltic material substantially normally thereto to evaporate the evaporative liquid from the asphaltic material in the loop, and further including means for sensing the surface moisture of the asphaltic material downstream from one or more of the cooling units, and means for modifying the flow of evaporative liquid sprayed in one or more of the cooling units in response to the sensed surface moisture.

In a preferred embodiment of the invention, the means for sensing the surface moisture is positioned downstream from all of the cooling units.

According to this invention, there is also provided apparatus for cooling a continuously moving strip of asphaltic material comprising means for directing the asphaltic material into a plurality of loops, in a plurality of cooling units, each of the cooling units being associated with one of the loops, and each cooling unit comprising spraying means positioned to spray evaporative liquid onto the asphaltic material in the loop and air delivery means positioned immediately downstream from the spraying means and adapted to cause gases to impinge on the asphaltic material substantially normally thereto to evaporate the evaporative liquid from the asphaltic material in the loop, and further including means for sensing the temperature of the asphaltic material downstream from one or more of the cooling units, and means for modifying the flow of evaporative liquid sprayed in one or more of the cooling units in response to the sensed temperature.

DESCRIPTION OF THE INVENTION

Figure 1:
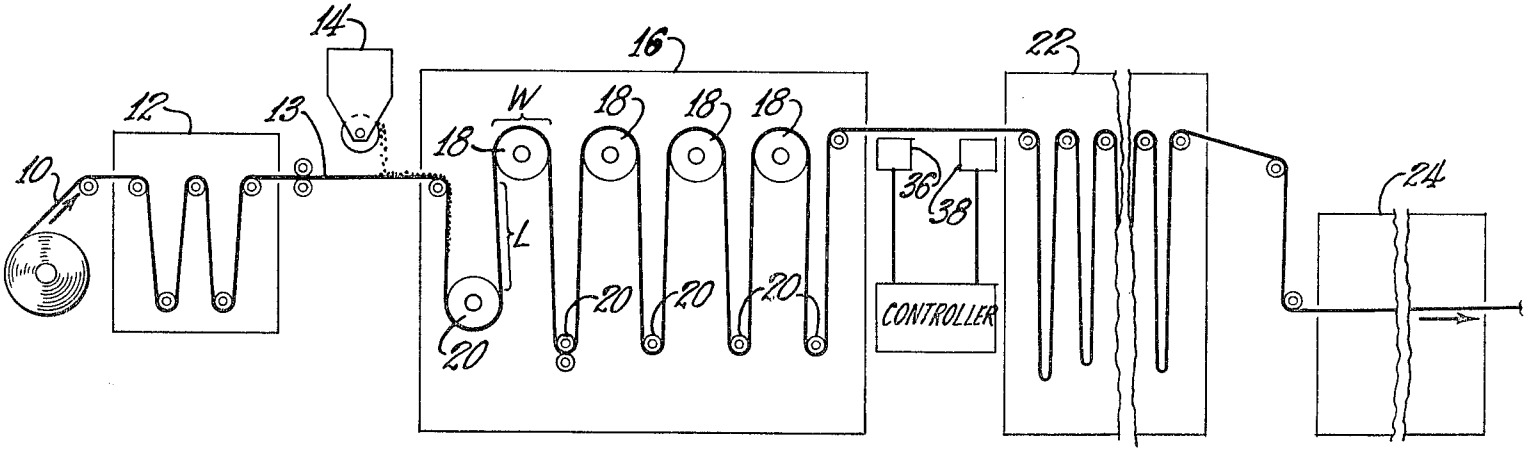
FIG. 1 is a schematic cross-sectional view in elevation of apparatus for producing asphaltic strip material according to the principles of this invention.

As shown in FIG. 1, base sheet 10, which can be an organic felt or a glass fiber mat, is passed through saturator 12 containing liquid asphalt to create continuous hot strip 13 of asphaltic material. The hot asphaltic strip can then be passed beneath granule applicator 14 which applies the surface coating granules to a portion of the asphaltic strip. Subsequently, the asphaltic strip is passed through cooling section 16 where it is cooled and dried. Within the cooling section, the asphaltic strip can be directed by upper pulleys 18 and lower pulleys 20 into a plurality of loops having lengths L and widths W. Preferably, the lengths are generally vertical. After passing through the cooling section, the cooled and dried asphaltic strip can be directed into temporary storage looper 22 which accumulates the asphaltic strip prior to its delivery to shingle cutter 24, and packaging operations, not shown.

Figure 2:
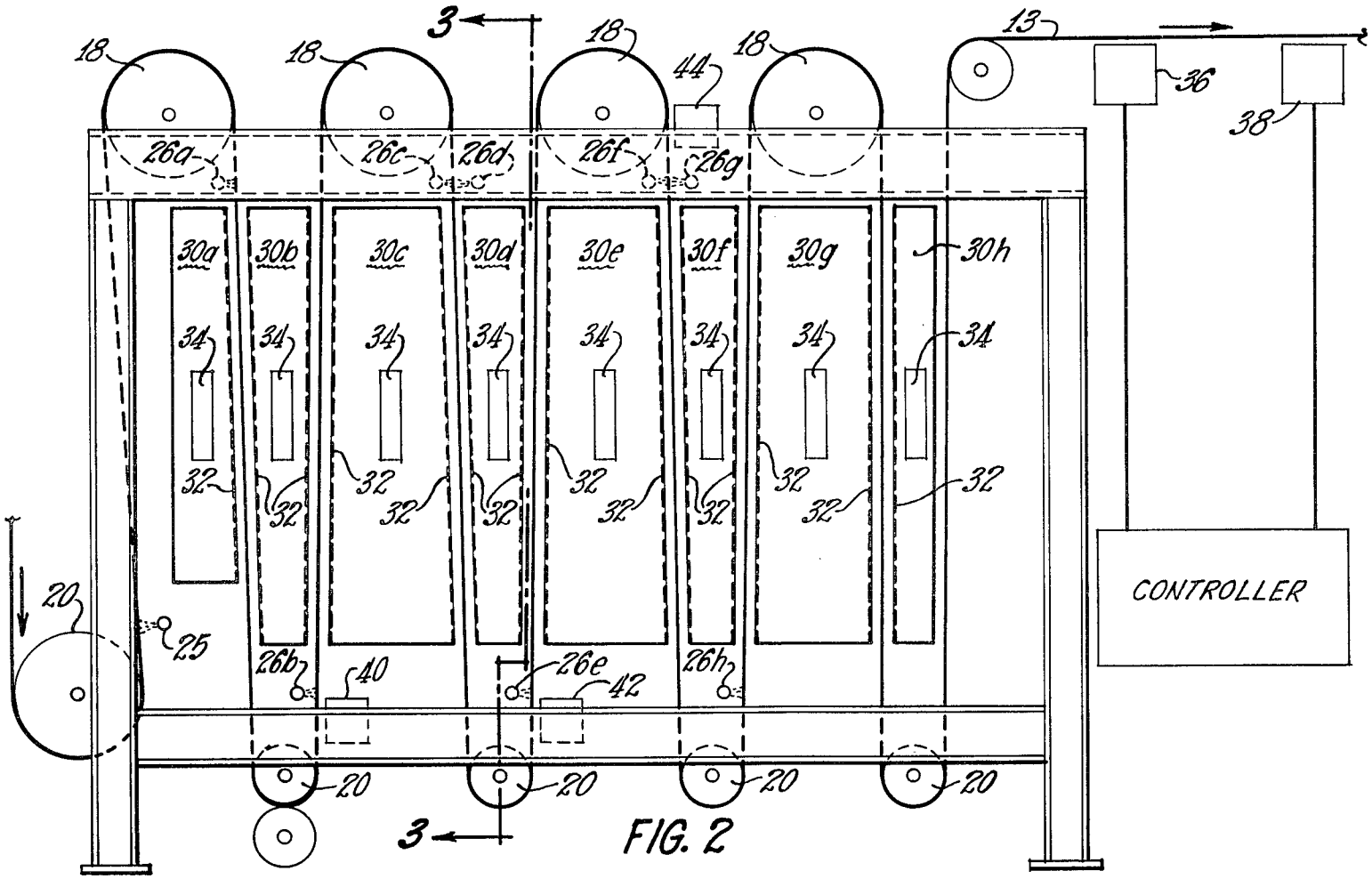
FIG. 2 is a schematic cross-sectional view in elevation of the cooling section of the production machine of FIG. 1.
Figure 3:
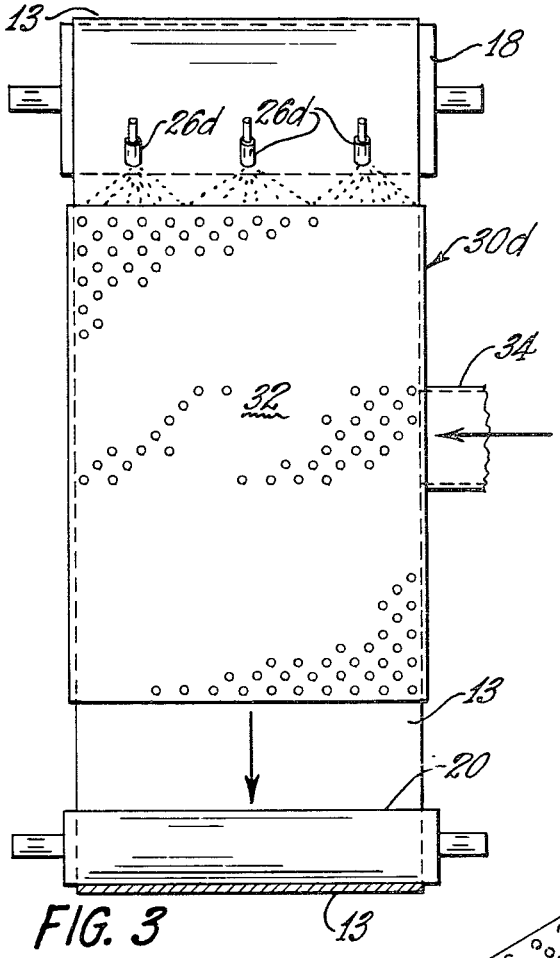
FIG. 3 is a schematic vertical section on line 3—3 of FIG. 2.

As shown in FIG. 2, an initial means for applying water to the asphaltic strip as it enters the cooling section, such as nozzle 25, can be positioned at the entrance of the cooling section. The water from this nozzle flashes to steam during normal operation due to the high temperature of the asphaltic strip. Spraying means, such as nozzles **26*a* through 26*h*, are positioned upstream from various ones of the vertical lengths of the loops for spraying an evaporative liquid, such as water, onto the asphaltic material. As shown in FIG. 3**, the spraying means can be comprised of a series of three nozzles positioned across the width of the continuous strip of asphaltic material. The nozzles are supplied from a source of evaporative liquid, not shown.

Positioned immediately downstream from each of the nozzles **26*a* through 26*h* are air delivery means 30*a* through 30*h* for evaporating the water on the strip material immediately downstream from each of the nozzles. As can be seen in FIGS. 2 and 3**, associated with each loop is a cooling unit comprised of a set of nozzles for spraying water immediately followed by an air delivery means for evaporating the water. Thus, a series or plurality of cooling units carries out a plurality of cooling cycles on the strip material, each cycle having a water spraying step immediately followed by an evaporation step.

Figure 4:
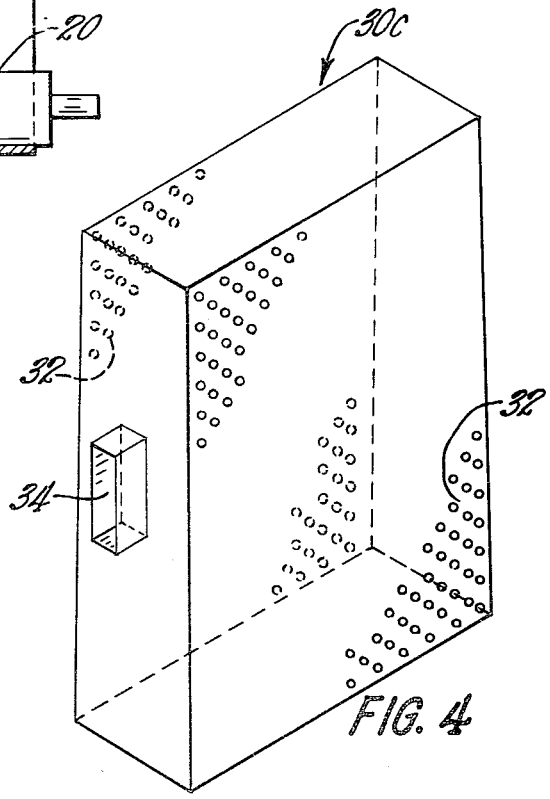
FIG. 4 is a perspective view of an air delivery means according to the principles of the invention.

Each of the air delivery means is comprised of a plenum defined by orificed plates 32 which are generally parallel to the lengths of asphaltic material in the loops. Preferably, the orifices in the plates are round, and deliver arrays of column-like air jets, although any flow of gases providing evaporation of the liquid will be suitable for purposes of this invention. Also, the orifices of the orificed plates preferably extend along the entire height of the plenums so that the arrays are supplied from the plenums over substantially the entire height of the loops, as shown in FIGS. 3 and 4. Air passing from the plenums through the orificed plates causes an array of air jets to impinge on the asphaltic material substantially normally to the lengths of asphaltic material. The impingement of the air jets in a direction normal to the surface to be cooled facilitates the rapid and efficient cooling of the asphaltic strip. Preferably, the impinging air jets supply air at a rate within the range of from about 60 to about 70 cfm per square foot of plenum surface.

As shown in FIGS. 2 through 4, the air can be supplied to the plenums by plenum conduits 34. The plenum conduits can be adapted with any means suitable for controlling the flow of air therethrough, such as dampers, not shown, in order to balance the force of the arrays of air jets impinging on opposite sides of the lengths. For example, the length of asphaltic material downstream from spray nozzle **26*b*, which is positioned between plenums 30*b* and 30*c***, is subject to the force of the arrays of air jets impinging thereupon from those two plenums.

Positioned downstream from all the cooling units is moisture sensor 36. The moisture sensor can be any means suitable for measuring the amount of surface moisture on the asphaltic strip material traveling past the moisture sensor. A moisture sensor which would be sufficient for purposes of the invention would be a Quadri-Beam Moisture Analyzer, Model 475 manufactured by Moisture Systems Corporation, Hopkinton, Mass.

Also positioned downstream from the cooling units is temperature sensor 38, which can be any temperature sensing device suitable for measuring the temperature of the asphaltic strip material traveling past the temperature sensor. A device suitable for purposes of the invention would be a Williamson Model 4200 Infrared Temperature Sensing device. Although the moisture sensor and temperature sensor are shown as being positioned immediately downstream from the cooling section, either the moisture sensor or the temperature sensor, or both, can be positioned immediately upstream from the shingle cutter while continuing to operate under the principles of this invention. The moisture sensor and temperature sensor can be wired to a controller in order to provide control for the cooling taking place in the cooling section. The controller can be any means suitable, such as a microprocessor, for receiving data from the sensors and modifying the water flow from the spray nozzles.

As shown in FIG. 2, some of the cooling units can be provided with additional moisture sensors, such as moisture sensors 40, 42 and 44. Moisture sensor 40, for example, measures the surface moisture on the asphaltic strip material after the strip material has passed through the cooling unit comprised of spray nozzles **26*a* and plenums 30*a* and 30*b***. All of the moisture sensors are connected to the controller by means, not shown.

In operation, the controller can be programmed to control the operation of the spray nozzles in response to all of the moisture sensors. Preferably, the controller is programmed to sequentially stop or decrease the flow of evaporative liquid sprayed from the spray nozzles, in the order beginning with the furthest downstream of the cooling units toward furthest upstream of the cooling units, in response to the sensed surface moisture of the sensors. It is preferable that no new cooling cycle be initiated if the asphaltic strip material emerging from the previous cooling cycle has not been substantially dried. Thus, for example, if moisture sensor 36 indicates wet asphaltic material, then the controller would decrease or stop the flow of water from nozzles **26*h*. Also, if moisture sensor 44 indicates that the asphaltic strip material is wet, then spray nozzles 26*e*** are either stopped or reduced in flow of evaporative liquid.

In the preferred embodiment of the invention, the sensing and slowing or stopping of the flow of liquid from various cooling units is done in a sequential order in the reverse machine direction. This can be done regardless of the number of moisture sensors, provided that there is one moisture sensor positioned downstream from all the controlled cooling units. For example, if moisture sensor 36 indicates that the asphaltic strip material is not substantially dry, then spray nozzles **26*h* can be stopped. If the moisture sensor still indicates a wet asphaltic strip, then spray nozzles 26*f*, 26 *g* and 26*h* are turned off. In the event that stopping the flow of evaporative liquid from spray nozzles 26*f*, 26*g* and 26*h* is insufficient to provide a dry shingle as measured by moisture sensor 36, then spray nozzles 26*e* are turned off. Thus, the nozzles are sequentially turned off or slowed down in the reverse machine direction until a condition of a dry shingle is sensed by the moisture sensor. Therefore, this invention encompasses both the control of the entire cooling section by one moisture sensor, such as moisture sensor 36, and the control of individual cooling units by moisture sensors positioned immediately downstream from those cooling units, such as moisture sensors 40, 42, and 44**.

The positioning of additional temperature sensors, not shown, following individual cooling units can be effected in a manner similar to the placement of additional moisture sensors 40, 42 and 44. In operation, the nozzles of the cooling units can be sequentially turned on in the machine direction in response to a condition of sensed temperature above a predetermined temperature, in order to cool the asphaltic material prior to its being cut into shingles.

INDUSTRIAL APPLICABILITY

This invention will be found to be useful in the continuous production of asphaltic strip material for such uses as asphalt shingles.

We claim:

1. A method for cooling a continuously moving strip of asphaltic material comprising:

a. subjecting said asphaltic material to a plurality of cooling cycles, each cooling cycle comprising spraying evaporative liquid onto said asphaltic material from a means for spraying, and evaporating said liquid immediately downstream from said means for spraying by causing gases to impinge on said asphaltic material substantially normally to said asphaltic material;

b. sensing the surface moisture of said asphaltic material subsequent to said cooling cycles;

c. sequentially stopping or decreasing the flow of evaporative liquid sprayed, in the order beginning with the furthest downstream of said cycles toward the furthest upstream of said cycles, in response to the sensed surface moisture.

2. A method for cooling a continuously moving strip of asphaltic material comprising:

a. subjecting said asphaltic material to a plurality of cooling cycles, each cooling cycle comprising spraying evaporative liquid onto said asphaltic material from a means for spraying, and evaporating said evaporative liquid immediately downstream from said means for spraying by causing gases to impinge on said asphaltic material substantially normally to said asphaltic material;

b. sensing the temperature of said asphaltic material downstream from said cooling cycles; and c. sequentially starting or increasing the flow of evaporative liquid sprayed, in the order beginning with the furthest upstream of said cycles toward the furthest downstream of said cycles, in response to the sensed temperature.

* * * * *